US006369761B1

(12) United States Patent
Thiam et al.

(10) Patent No.: US 6,369,761 B1
(45) Date of Patent: Apr. 9, 2002

(54) DUAL-BAND ANTENNA

(75) Inventors: Cheikh T. Thiam, Grand Blanc; Andreas Dirk Fuchs, Orion Township; Ralf Lindackers, Waterford; Daniel R. Phillips, Flint, all of MI (US)

(73) Assignee: RecepTec L.L.C., Holly, MI (US)

( * ) Notice: Subject to any disclaimer, the term of this patent is extended or adjusted under 35 U.S.C. 154(b) by 0 days.

(21) Appl. No.: 09/686,391

(22) Filed: Oct. 9, 2000

Related U.S. Application Data

(60) Provisional application No. 60/198,080, filed on Apr. 17, 2000.

(51) Int. Cl.[7] ..... H01Q 1/38

(52) U.S. Cl. ..... 343/700 MS; 343/702; 343/846

(58) Field of Search ..... 343/700 MS, 846, 343/848, 702

(56) References Cited

U.S. PATENT DOCUMENTS

| | | | | |
|---|---|---|---|---|
| 4,994,820 A | | 2/1991 | Suzuki et al. | 343/846 |
| 5,003,318 A | * | 3/1991 | Berneking et al. | 343/700 MS |
| 5,291,210 A | * | 3/1994 | Nakase | 343/700 MS |
| 5,307,075 A | * | 4/1994 | Huynh | 343/700 MS |
| 5,703,601 A | * | 12/1997 | Nalbandian et al. | 343/700 MS |
| 5,767,810 A | * | 6/1998 | Hagiwara et al. | 343/700 MS |
| 5,917,450 A | * | 6/1999 | Tsunekawa et al. | 343/700 MS |
| 6,239,750 B1 | * | 5/2001 | Snygg | 343/700 MS |

FOREIGN PATENT DOCUMENTS

| | | | |
|---|---|---|---|
| FR | 2709878 | 3/1995 | H01Q/13/26 |

OTHER PUBLICATIONS

Choon Sae Lee & Vahakn Nalbandian, Planar Circularly Polarized Microstrip Antenna with a Single Feed 47 IEEE Transactions on Antennas and Propagation 1005 (Jun. 1999).

* cited by examiner

*Primary Examiner*—Don Wong
*Assistant Examiner*—Hoang Nguyen
(74) *Attorney, Agent, or Firm*—Warner Norcross & Judd LLP

(57) ABSTRACT

The specification discloses a dual-band antenna for receiving signals in both the PCS (digital phone) and AMPS (analog phone) frequency ranges. The antenna includes a ground plane, and upper and lower antenna elements spaced both from one another and from the ground plane. The two elements and the ground plane are parallel to one another. A plurality of shorting posts symmetrically arranged about the lower element connect the lower element to the grounding plane. A probe or lead interconnects the centers of the upper and lower antenna elements. The lower element is tuned to a first frequency range, and the upper and lower elements together are tuned to a second frequency range.

13 Claims, 12 Drawing Sheets

FREQUENCY 0.824 TO 0.88813 GHz
MEASURED S11 OF DUAL BAND PATCH

FREQUENCY 0.0066 GHz/DIV
MEASURED S11 (dB) OF DUAL BAND PATCH

FREQUENCY 1.88506 TO 1.99 GHz
MEASURED S11 OF DUAL BAND PATCH

FREQUENCY 0.0105 GHz/DIV
MEASURED S11 (dB) OF DUAL BAND PATCH

FREQUENCY 0.2332 GHz/DIV
MEASURED S11 (dB) OF DUAL BAND PATCH

DUAL-BAND ANTENNA

This application claims priority from Provisional Application No. 60/198,080 filed Apr. 17, 2000, and entitled "Dual-Band, Omnidirectional, Vertically Polarized Antenna".

BACKGROUND OF THE INVENTION

Ever expanding mobile communications require increasingly sophisticated antenna technology. The need for antennas capable of operating at multiple bands is continually increasing. Two options exist to meet this need—multiple antennas or multiple-band antennas. Several multiple-band antennas have been developed, but all suffer drawbacks.

The quarter-wave monopole is currently the most popular mobile antenna. A monopole can be a dual-band antenna if it includes a coil or "choke" along its length. The monopole antenna with the choke provides dual-band functionality. However, the monopole antenna has drawbacks. First, it is aesthetically undesirable. Second, because it must extend from an exterior portion of the car, it is subject to damage and theft, as well as being a nuisance in going through carwashes.

Another dual-band antenna is the "Andrew" antenna, which has a "bow tie" configuration. This antenna also has drawbacks. First, it must be mounted inside the car, which reduces its performance well below the performance of a quarter-wave monopole. Second, it does not possess the omnidirectionality required for mobile communication applications.

The planar inverted F antenna (also know as a U-shape or an L-shape) is a single-band, low-profile antenna that provides performance comparable to a quarter-wave monopole. The low profile enables the antenna to be quite unobtrusive, even on a vehicle exterior. However, to handle multiple bands, multiple single-band antennas must be used.

SUMMARY OF THE INVENTION

The aforementioned problems are overcome in the present invention comprising a dual-band antenna having an extremely low profile and being relatively compact. Specifically, the antenna includes a ground plane and upper and lower planar elements all parallel to one another and spaced from one another. The lower element is connected to the ground plane through a plurality of shorting posts. A probe or lead interconnects the centers of the upper and lower elements to provide an antenna lead. The lower element alone is responsive to a first frequency band (the higher frequency band); and the coupled upper and lower elements are responsive to a second frequency band (the lower frequency band).

The present antenna has an extremely low profile and is highly compact. It is well suited for mounting in a wide variety of locations inside or outside of a vehicle.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
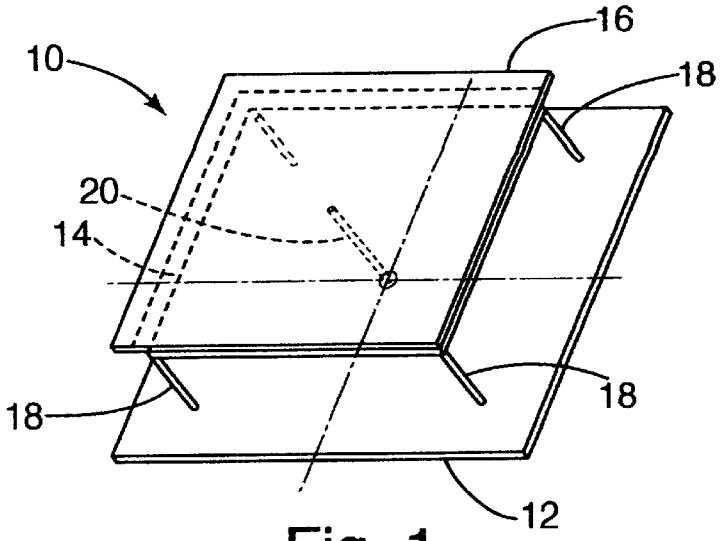
FIG. 1 is a perspective view of the dual-band antenna of the present invention.
Figure 2:
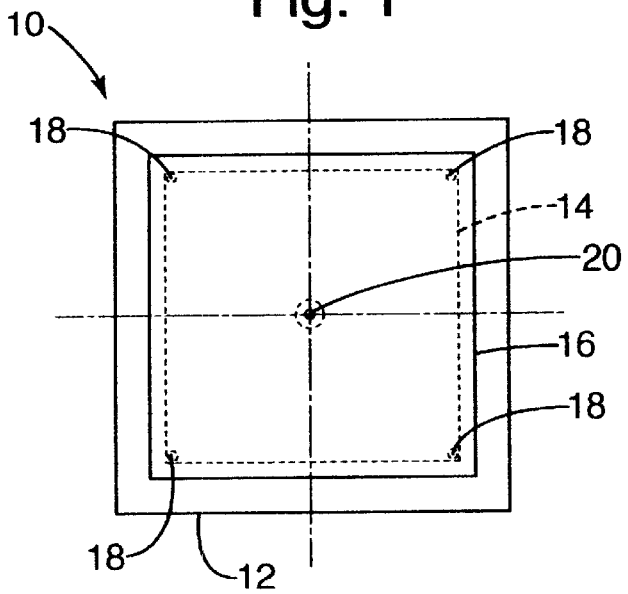
FIG. 2 is a top plan view of the antenna.
Figure 3:
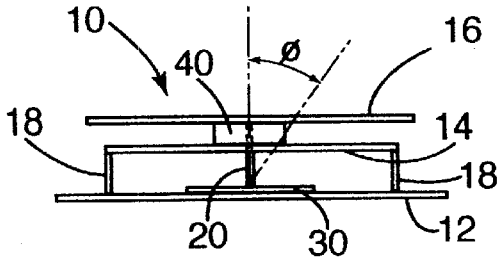
FIG. 3 is a side elevation view of the antenna.
Figure 4:
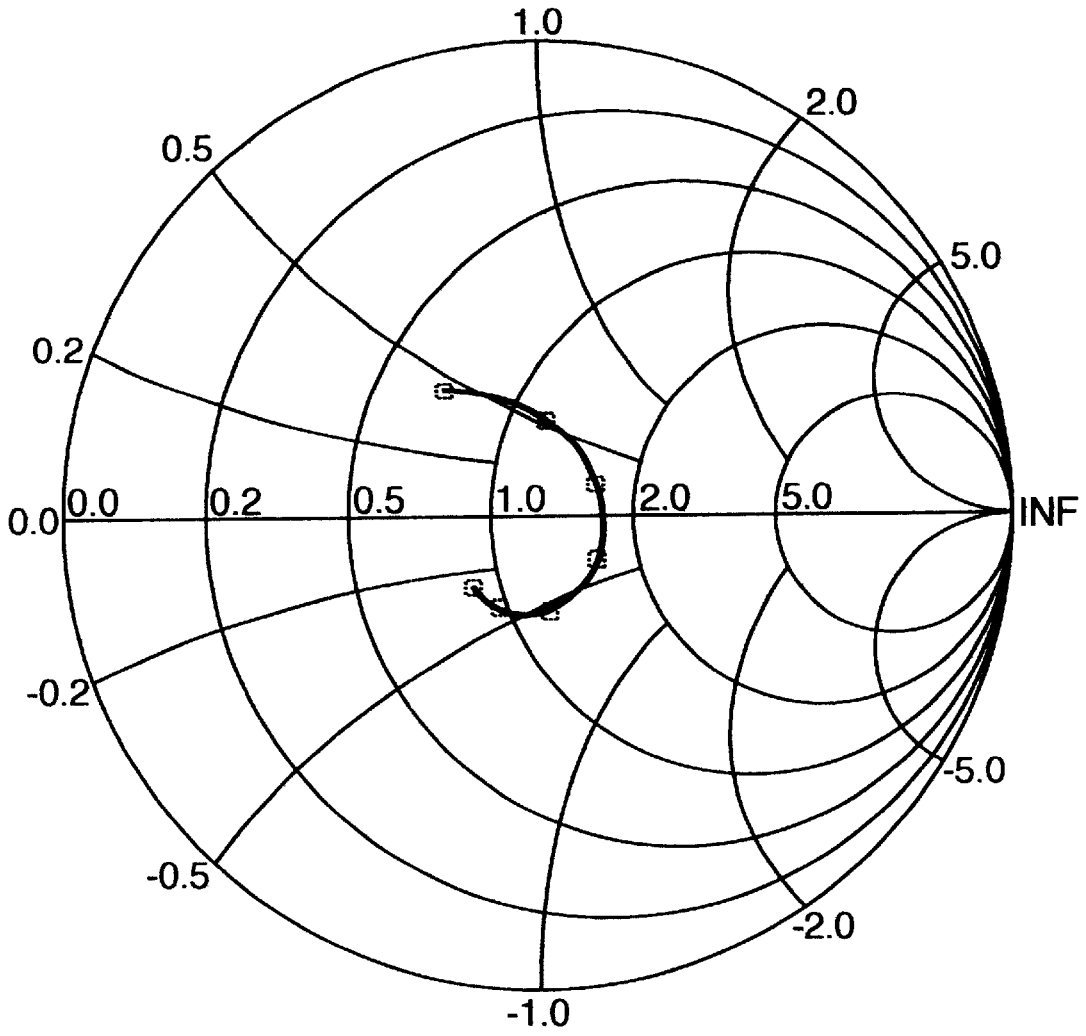
FIG. 4 is a plot showing the measured S11 of the antenna from 824 to 890 MHz.
Figure 5:
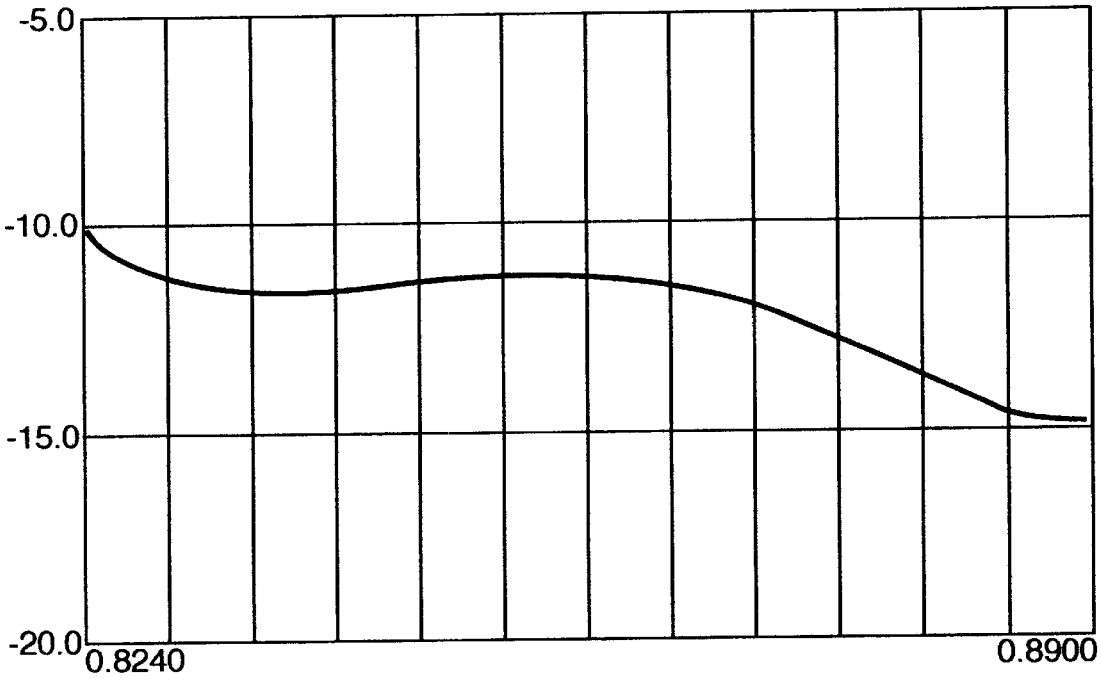
FIG. 5 is a plot showing the magnitude of S11 from 824 to 890 MHz.
Figure 6:
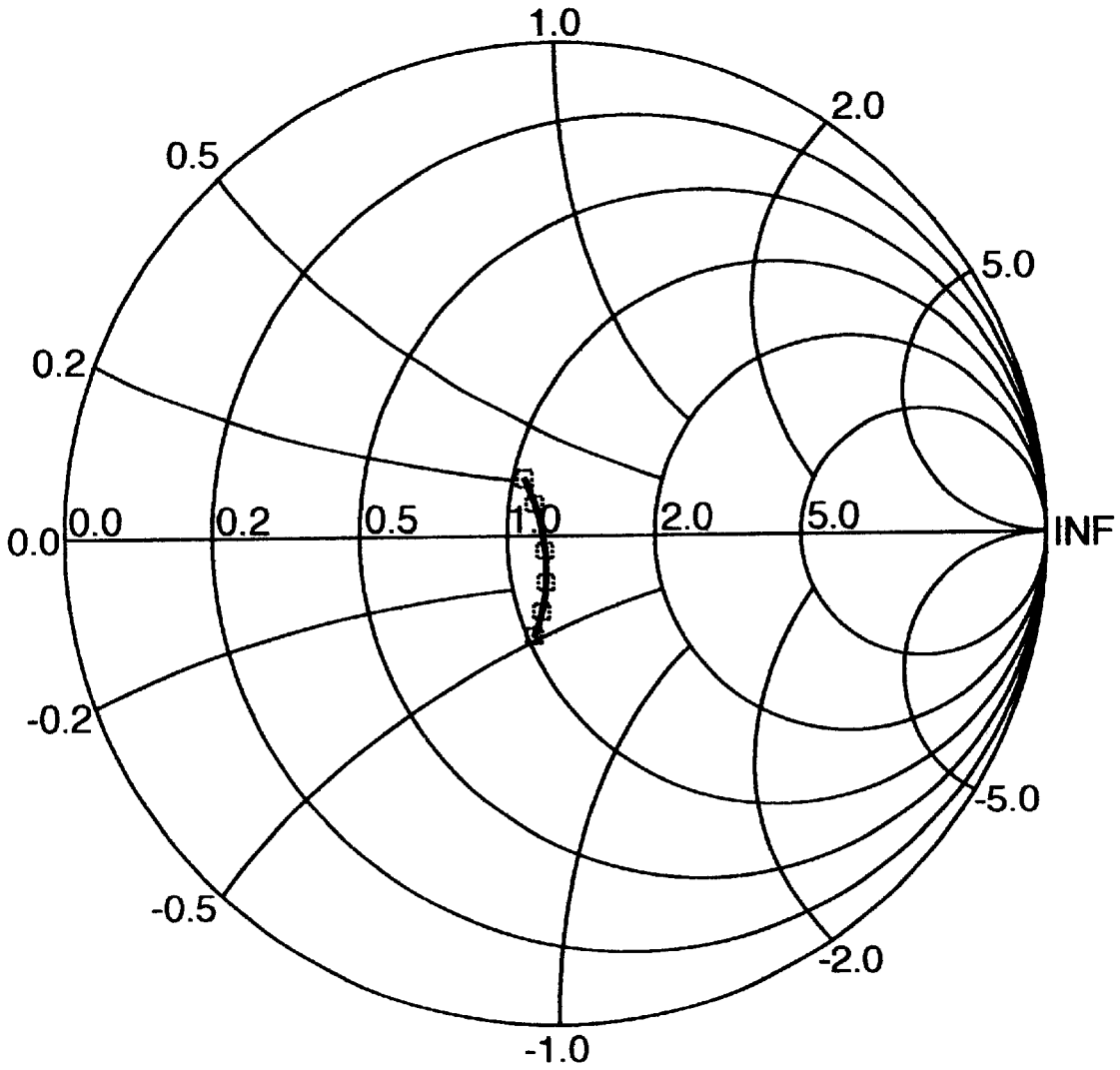
FIG. 6 is a plot showing the measured S11 from 1885 to 1990 MHz.
Figure 7:
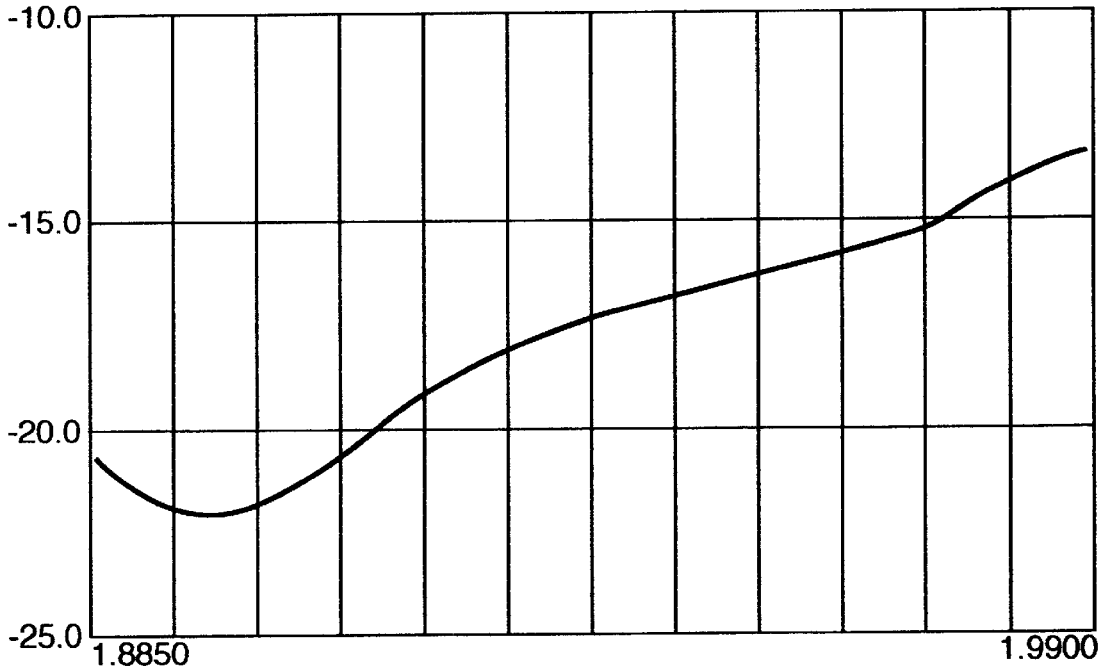
FIG. 7 is a plot showing the magnitude of the measured S11 in dB.
Figure 8:
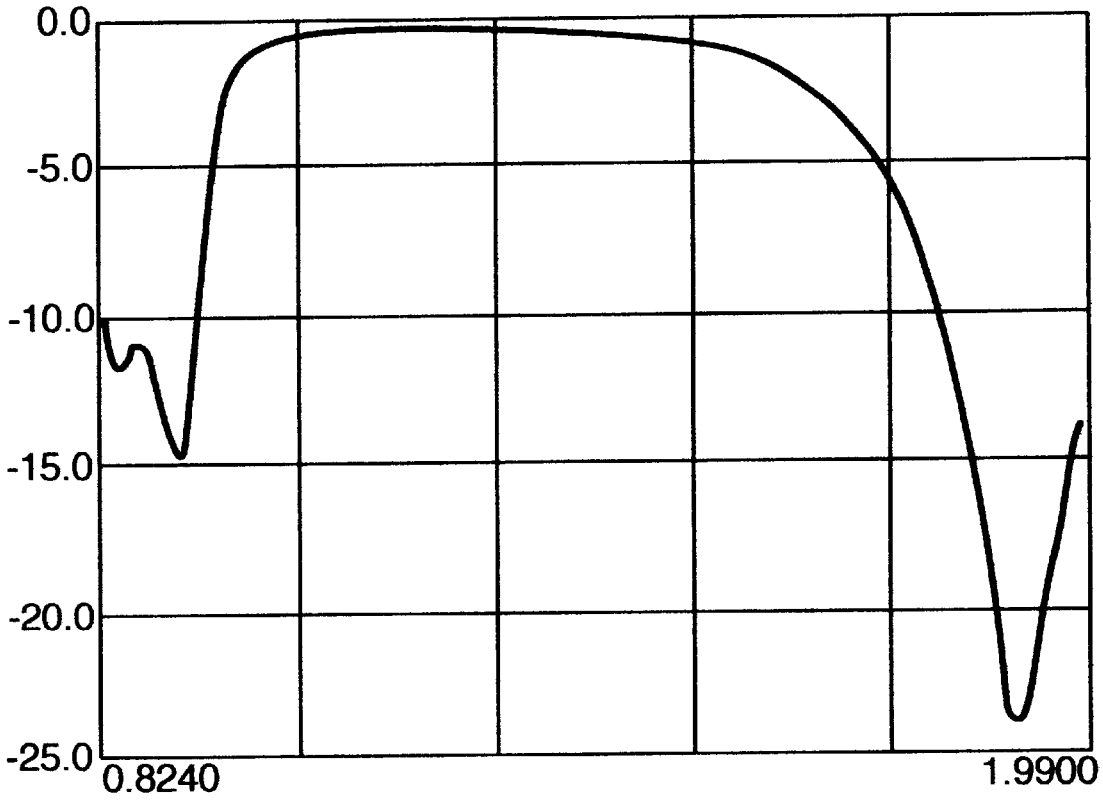
FIG. 8 is a plot showing the measured magnitude of S11 from 824 to 1990 MHz.
Figure 9:
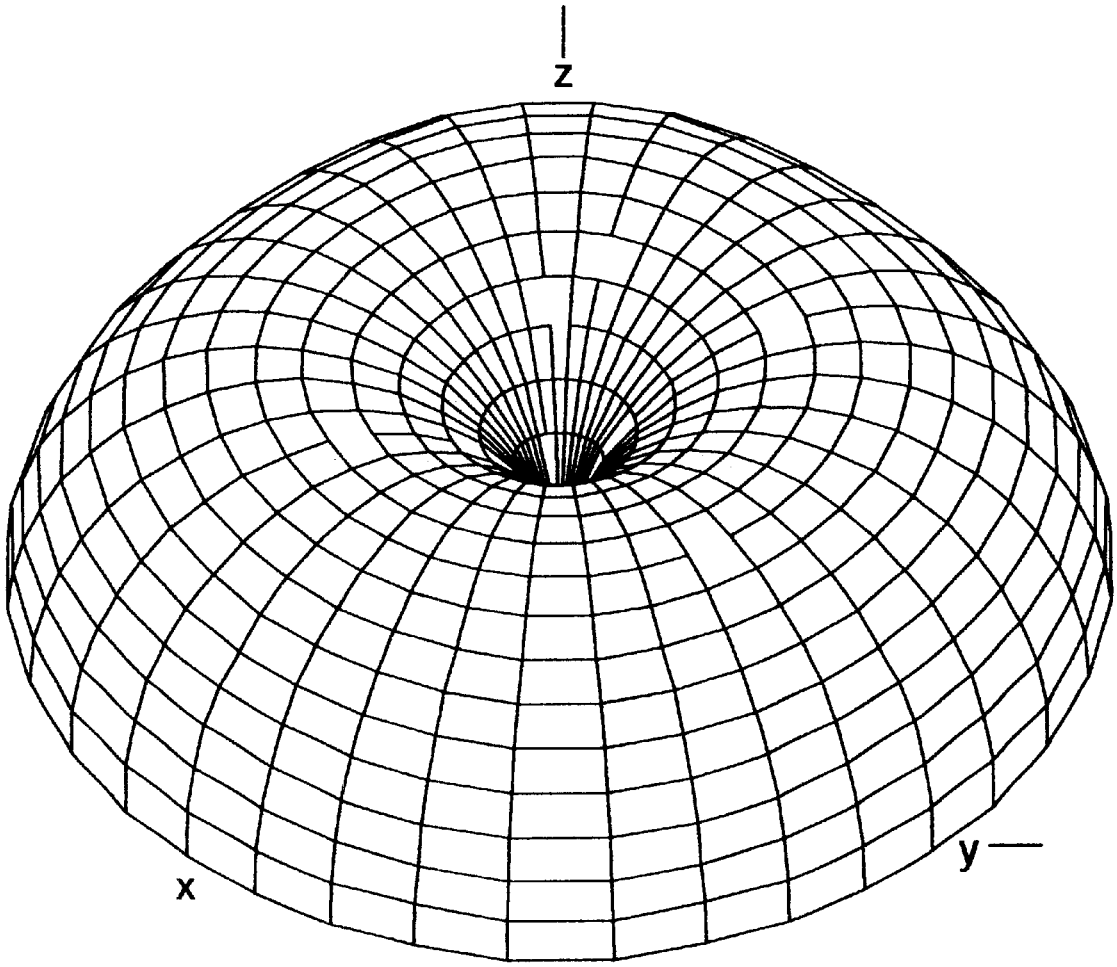
FIG. 9 is a plot of the vertical component of the far field computed at 900 MHz.
Figure 10:
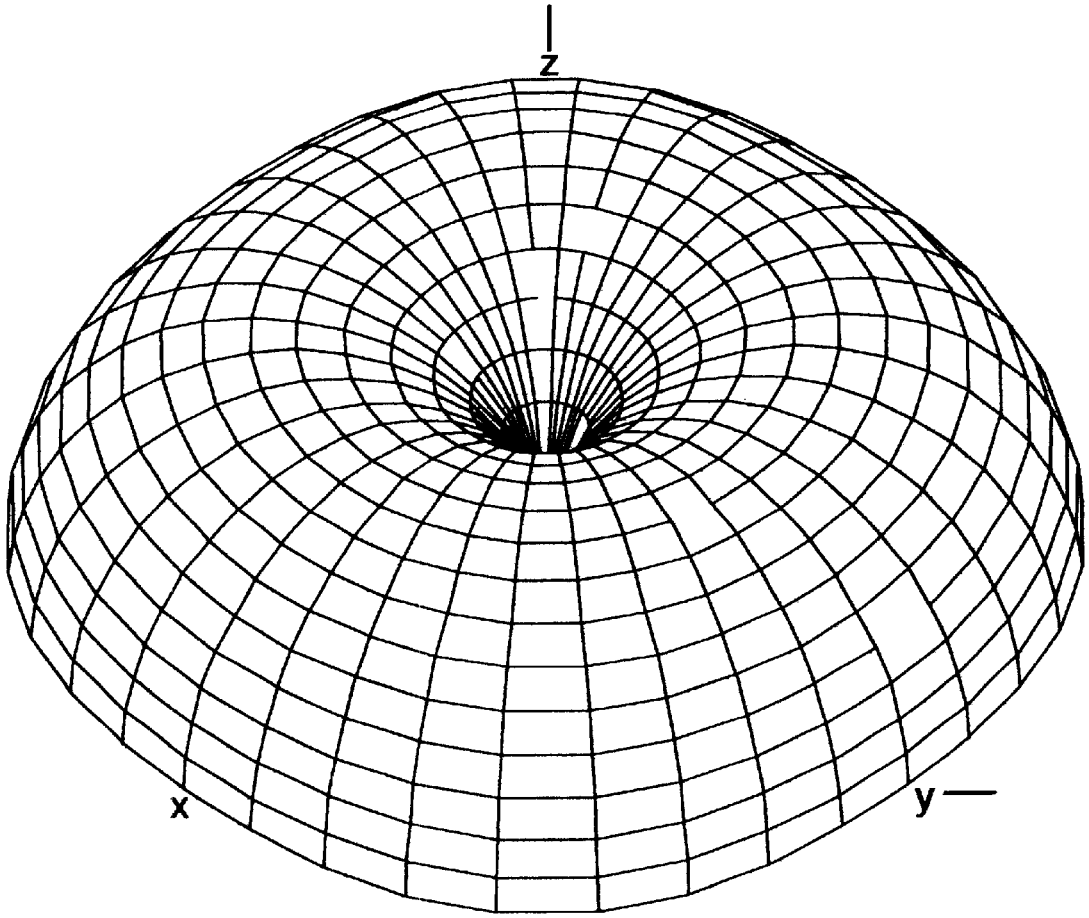
FIG. 10 is a plot showing the vertical component of the field calculated at 1990 MHz.
Figure 11:
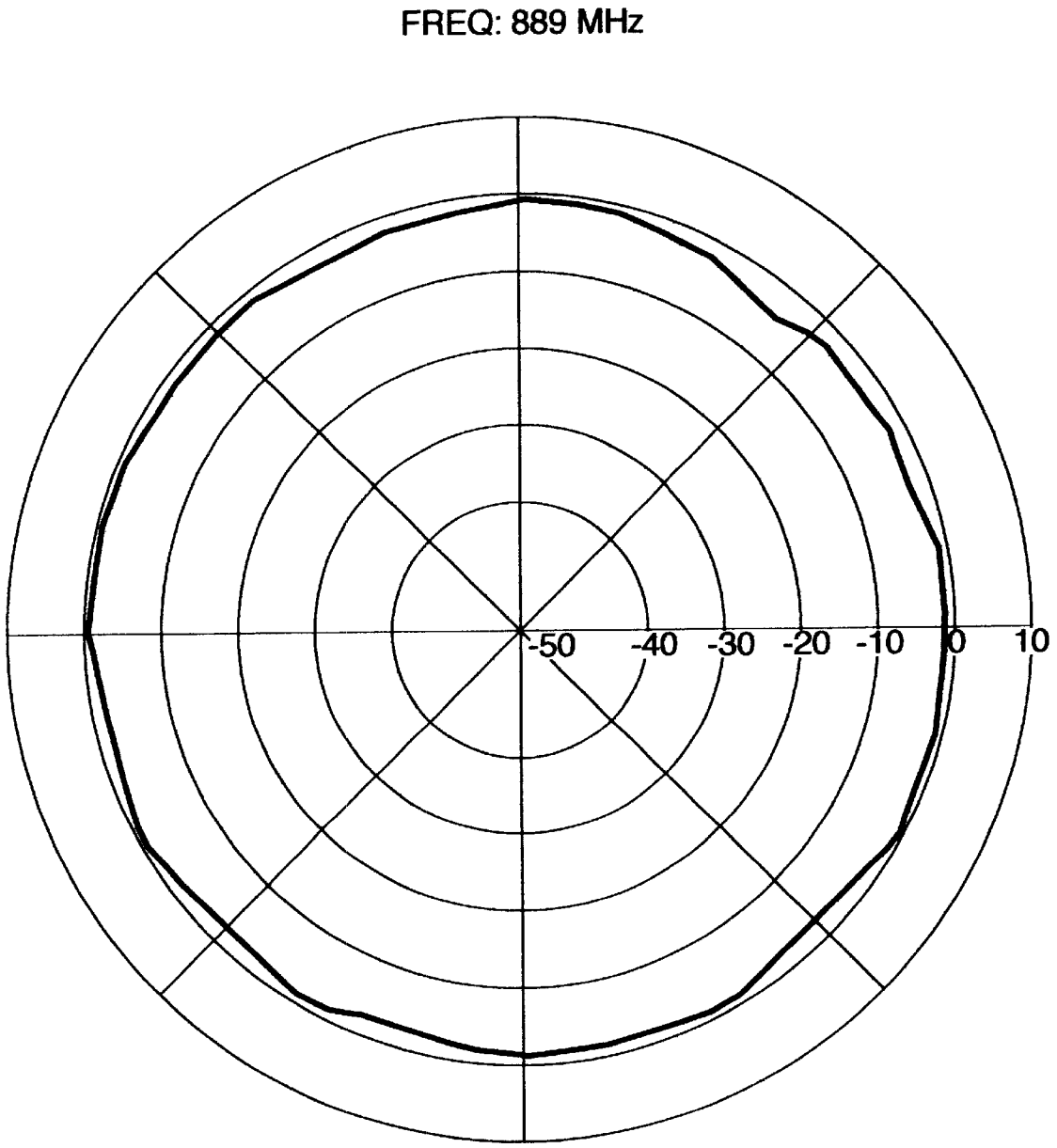
FIG. 11 is a plot of the vertical component of the far field measured at 889 MHz.
Figure 12:
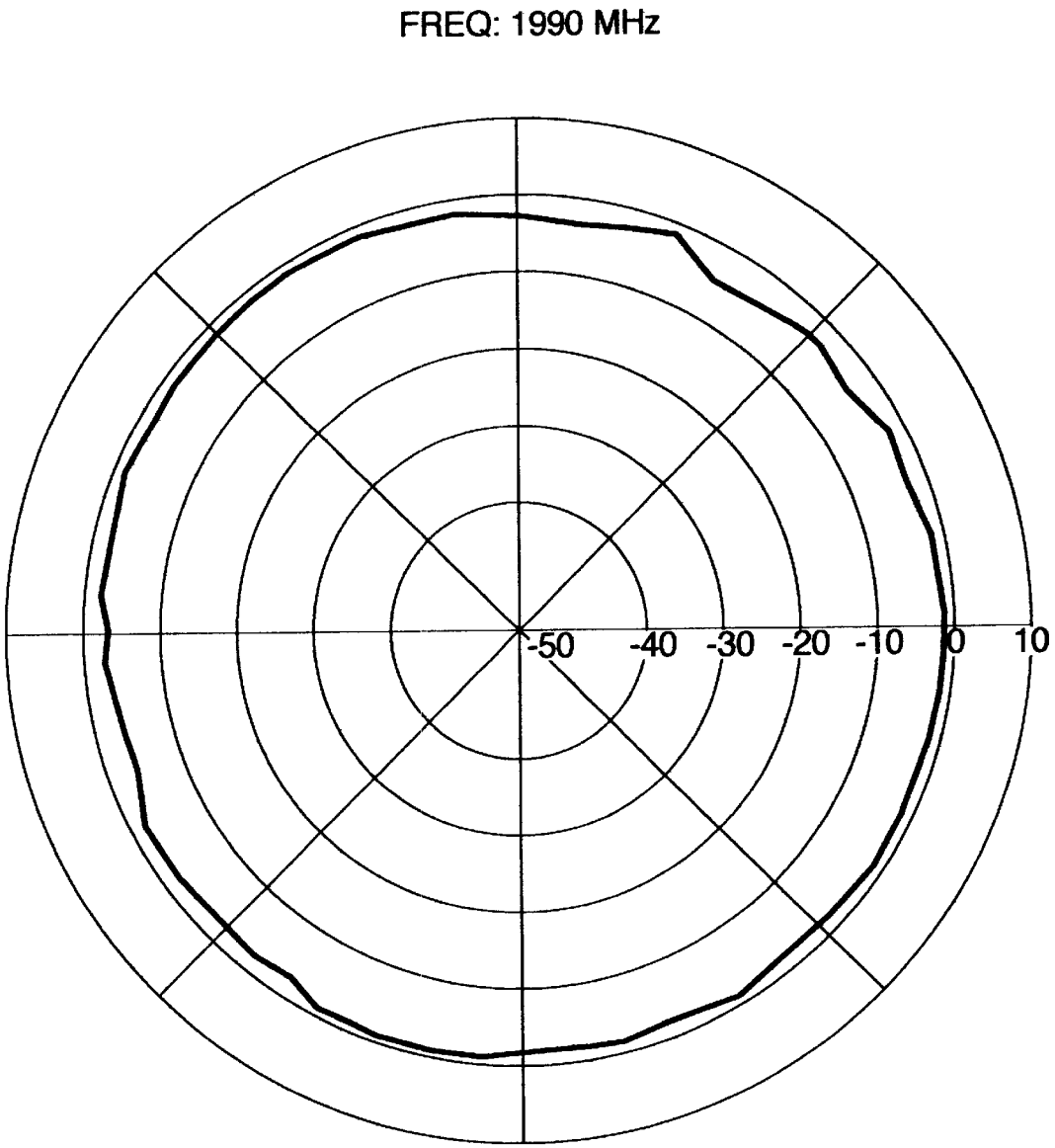
FIG. 12 is a plot showing the vertical component of the field measured at 1990 MHz.
Figure 13:
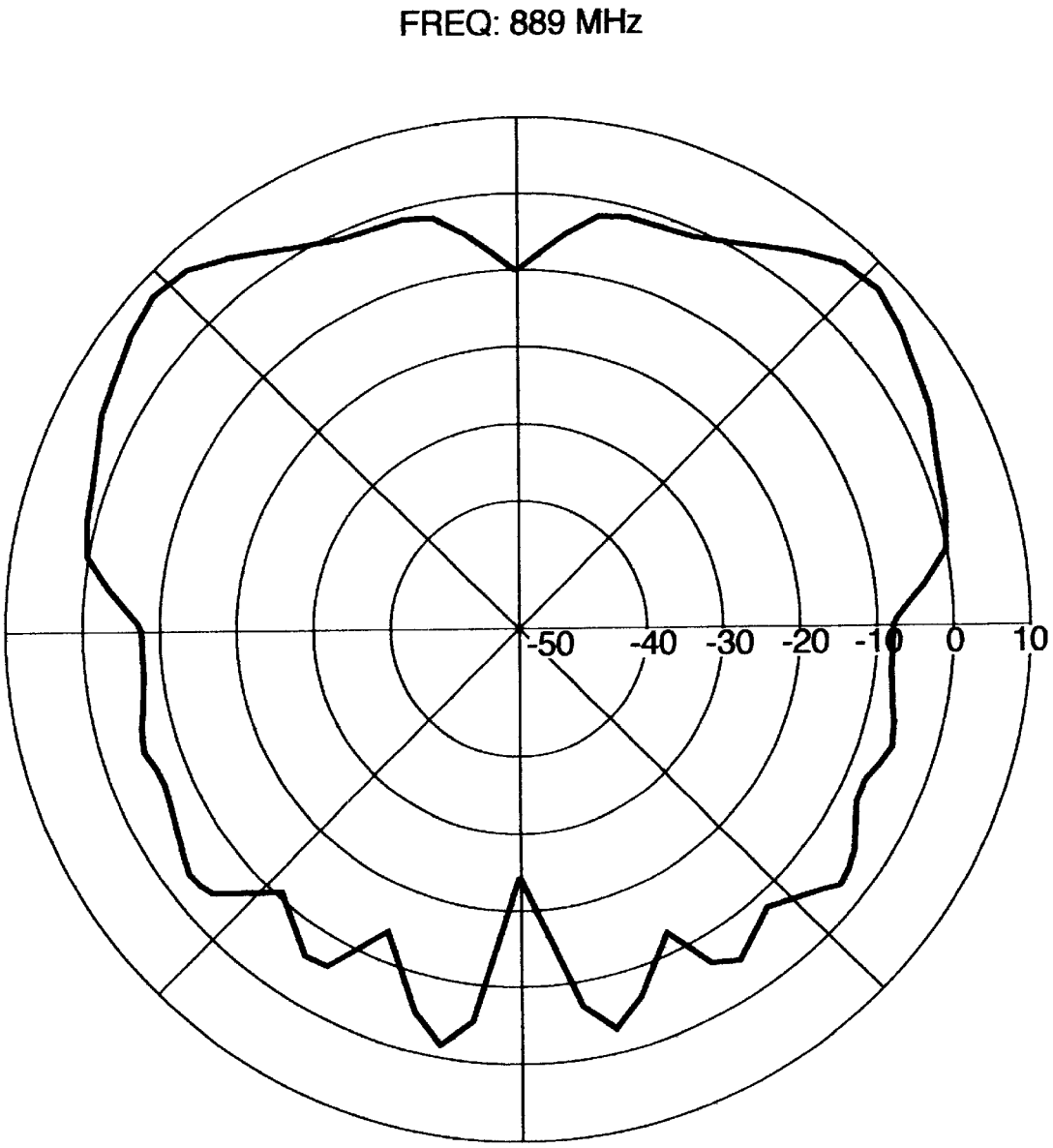
FIG. 13 is a plot showing the vertical component of the electric field measured in the half-space $-\pi/2 \leqq \theta \leqq \pi/2$ in the plane y=0 at 889 MHz.
Figure 14:
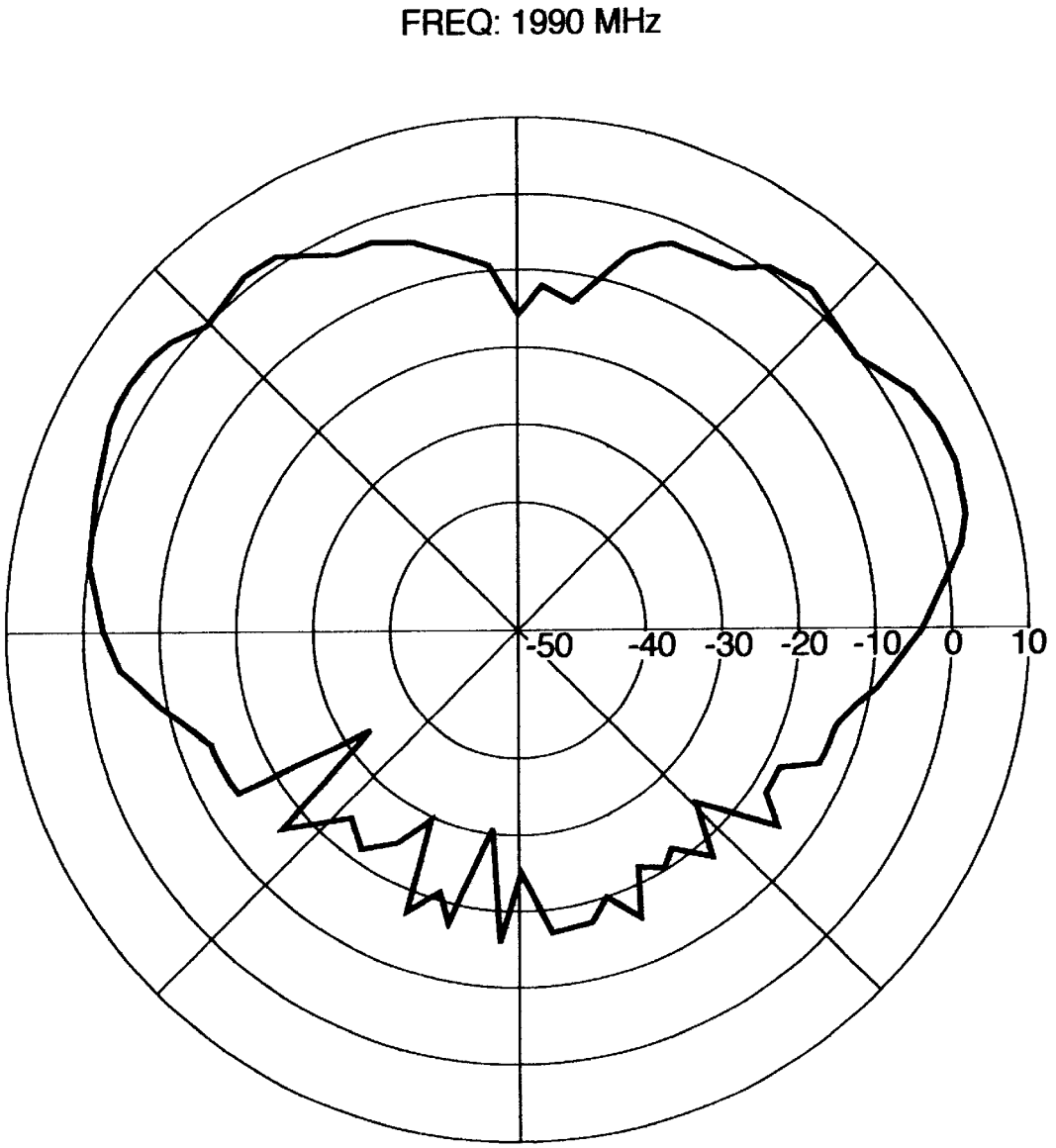
FIG. 14 is a plot showing the vertical component of the electric field measured in the half-space $-\pi/2 \leqq \theta \leqq \pi/2$ in the plane y=0 at 1190 MHz.

A dual-band antenna constructed in accordance with a preferred embodiment of the invention is illustrated in FIGS. 1–3 and generally designated 10. The antenna includes a ground plane 12, a lower antenna element 14, an upper antenna element 16, a plurality of shorting posts 18, and a probe or lead 20. The lower element 14 is supported on the grounding plane 12 by way of the grounding posts 18. The probe 20 interconnects the upper element 16 and the lower element 14.

The ground plane 12 is larger than both of the elements 14 and 16, so that the grounding plane extends beyond both elements in every direction. A micro-strip 30 is mounted on the grounding plane 12 in conventional fashion. The ground plane and the micro-strip, as well as all other elements of the preferred embodiment are fabricated of conventional materials well know to those skilled in the antenna art.

The lower element 14 is generally square, is spaced from the grounding plane 12, and is generally parallel to the grounding plane 12. The shape of the lower element 14 is preferably any regular shape, such as a circle or a regular polygon, although other shapes may be used. "Generally square" and "generally parallel" designate shapes and relationships providing functionality substantial similar to the described antenna.

Four shorting posts 18 physically and electrically interconnect the lower element 14 and the grounding plane 12. Preferably, the shorting posts are symmetrically arranged about the perimeter of the lower element. In the preferred embodiment, wherein the lower element 14 is square, one shorting post is positioned at each of the four corners of the lower element. The diameter of the shorting posts is selected to adjust the resonant frequency of the lower element 14 (the higher frequency band). Consequently, the lower element may be smaller than if the shorting posts were not included.

The upper element 16 also is generally square and is somewhat larger than the lower element 14. As with the lower element 14, the upper element 16 can assume a wide variety of shapes. Preferably, the shape of the upper element 16 is generally the same as the shape of the lower element 14. In other words, preferably they are both squares, both circles, or so forth. Again in the preferred embodiment, the peripheral edge of the upper element 16 extends outwardly beyond the peripheral edge of the lower element 14 at all points.

An insulating spacer 40 provides spacing between the lower element 14 and the upper element 16.

The probe 20 electrically interconnects the lower element 14 and the upper element 16. Preferably, the probe taps the center of each element and is also electrically connected to the micro-strip 30 to provide a lead for the antenna. Coupling the elements at their centers enhances the omnidirectional performance of the antenna. A coaxial lead (not shown) is electrically connected to the micro-strip 30 and probe 20 to provide a means of connecting the antenna 10 to conventional communication equipment.

The disclosed antenna is designed to operate in the PCS and AMPS frequency bands. PCS signals are in the frequency range of 1885 to 1990 MHz; and AMPS signals are in the frequency range of 824 to 894 MHz. In both bands, the fields are vertically polarized, and both formats are well known to those skilled in the art. Although the present invention is described in conjunction with those specific frequency ranges, the application of the invention to other frequency ranges will be readily apparent to those skilled in the antenna art.

Particularly with these specific frequency ranges in mind, the dimensional relationships of the elements will be described. The length of a side of the lower element 14 is approximately $\lambda/7$ at AMPS frequencies. Accordingly, the length of a side is approximately 50 millimeters (mm). Further, the preferred spacing between the lower element 14 and the ground plane 12 is $\lambda/32$ at AMPS frequencies or approximately 10–12 mm. When so designed, the lower element is tuned to the PCS frequency range.

Again, with the specific frequency ranges in mind, the length of the side of the upper element 16 is $\lambda/3$ at PCS frequencies or approximately 51–54 mm. Further, the preferred spacing between the upper element 16 and the ground plane 12 is $\lambda/32$ at PCS frequencies or approximately 4–5 mm.

The length and diameter of the shorting posts and the size of the lower element 14 control the upper resonant frequency. The distance between the elements 14 and 16, and the distance between the peripheral edges of the elements control the lower resonant frequency by means of a coupling loop in the impedance curve on the Smith chart. The size of the coupling loop, and the location of the loop on the impedance curve determine the resonant frequency and the bandwidth of the AMPS frequency. An appropriate shift of the coupling loop to the center of the Smith chart provides sensitivity to the lower band. Care must be taken in bringing this loop to the center of the Smith chart in order to maintain the upper resonance. This is done in the preferred embodiment using a matching network including a transmission line (not shown) and a passive nondissipative lump element (not shown) as is known to those skilled in the antenna art.

FIGS. 4–14 illustrate the performance of the dual-band antenna 10. In these figures, the x-y plane contains the ground plane and therefore is perpendicular to the y=0 plane. The half-space $-\pi/2 \leqq \theta \leqq \pi/2$ is assumed to be in the region containing the antenna.

FIGS. 4–14 show that the performance of the dual-band antenna 10 is nearly the same as the conventional quarter-wave monopole. The antenna has an omnidirectional pattern and nearly the same gain as a monopole. The antenna 10 radiates like a quarter-wave monopole. The match of the input impedance of the dual-band antenna is good with the return loss being below 10 dB in both bands. Further refinements and/or tuning of the antenna should further improve its performance.

Accordingly, the present invention provides a dual-band antenna with performance substantially similar to a quarter-wave monopole antenna. The present antenna has the additional advantages of being highly compact and having a relatively low profile. The present invention is therefore expected to have a wide range of applications and uses beyond the conventional quarter-wave monopole.

The above description is that of a preferred embodiment of the invention. Various alterations and changes can be made without departing from the spirit and broader aspects of the invention as defined in the claims, which are to be interpreted in accordance with the principles of patent law including the Doctrine of Equivalents.

The embodiments of the invention in which an exclusive property or privilege is claimed are defined as follows:

1. A dual-band antenna comprising:

a ground plane;

a first regularly shaped planar element spaced from and parallel to said ground plane;

a plurality of grounding posts interconnecting said first element and said ground plane, said ground posts being arranged symmetrically about said first element;

a second regularly shaped planar element larger than said first element, said second element being spaced from and parallel to both of said ground plane and said first element; and a probe interconnecting said first and second elements to provide a lead.

2. An antenna as defined in claim 1 wherein said probe is connected to the centers of said first and second elements.

3. An antenna as defined in claim 1 wherein said first and second elements are generally square.

4. An antenna element as defined in claim 1 wherein said first and second elements are generally circular.

5. An antenna element as defined in claim 1 further comprising a micro-strip mounted on said ground plane, said probe connected to said micro-strip.

6. A dual-band antenna comprising:

a ground plane;

a first generally planar element spaced from and generally parallel to said ground plane, said first planar element being a polygon including a plurality of vertices;

a plurality of shorting posts each interconnecting one and only one of said vertices and said ground plane;

a second generally planar element spaced from and generally parallel to said first element, said second element and said ground plane being on opposite sides of said first element; and a probe interconnecting said first and second elements to provide a lead.

7. An antenna as defined in claim 6 wherein said probe is connected to the center of each of said first and second elements.

8. An antenna element as defined in claim 6 wherein both of said first and second elements are regularly shaped.

9. An antenna as defined in claim 6 wherein said probe is connected to the center of each of said first and second elements.

10. A dual-band antenna comprising:

a ground plane;

a first regularly shaped generally planar element spaced from and generally parallel to said ground plane;

a plurality of shorting posts interconnecting said first element and said ground plane;

a second regularly shaped generally planar element spaced from and generally parallel to said first element, said second element being larger than said first element so that said second element completely overlies said first element; and a probe interconnecting said first and second elements to provide a lead.

11. A dual band antenna comprising:

a ground plane;

upper and lower generally square antenna elements spaced from and parallel to said ground plane, said upper element being larger than said second element whereby the peripheral edge of said upper element extends laterally beyond the peripheral edge said lower element, said lower element being positioned between said ground plane and said upper element:

four shorting posts electrically interconnecting each corner of said lower element with said ground plane;

a lead electrically interconnecting said upper and lower elements, said probe being connected to the center of each of said upper and lower elements.

12. An antenna element as defined in claim 11 further comprising a micro-strip mounted on said ground plane, said lead connected to said micro-strip.

13. A dual band antenna comprising:

a ground plane;

a first generally planar element having a circular or elliptical shape, said first element being bounded by an edge and defining a center, said first element spaced from and generally parallel to said ground plane;

a plurality of shorting posts interconnecting said first element and said ground plane, said shorting posts mounted to said first element at or between said edge and said center;

a second generally planar element spaced from and generally parallel to said first element; and a probe interconnecting said first and second elements to provide a lead.

* * * * *